US007073210B2

(12) United States Patent
Jiang

(10) Patent No.: US 7,073,210 B2
(45) Date of Patent: Jul. 11, 2006

(54) TOILET SEAT DEVICE FOR DISABLED PERSON

(76) Inventor: Jin Shan Jiang, P.O. Box 63-99, Taichung (TW) 406

( * ) Notice: Subject to any disclaimer, the term of this patent is extended or adjusted under 35 U.S.C. 154(b) by 116 days.

(21) Appl. No.: 10/832,062

(22) Filed: Apr. 23, 2004

(65) Prior Publication Data

US 2005/0235404 A1 Oct. 27, 2005

(51) Int. Cl.
*A47K 13/24* (2006.01)

(52) U.S. Cl. ..... 4/237; 4/254

(58) Field of Classification Search ..... 4/235, 4/237, 239, 254
See application file for complete search history.

(56) References Cited

U.S. PATENT DOCUMENTS 2,415,237 A * 2/1947 Dunn et al. ..... 4/239
5,412,815 A * 5/1995 Ellis ..... 4/239
5,787,518 A 8/1998 Mendelovich et al. ..... 4/449
5,809,584 A 9/1998 Potts ..... 4/254
6,324,705 B1 * 12/2001 Zephier ..... 4/254

* cited by examiner

*Primary Examiner*—Charles E. Phillips
(74) *Attorney, Agent, or Firm*—Charles E. Baxley

(57) ABSTRACT

A toilet seat device includes a seat disposing on a lavatory bowl, and a fastener device for detachably fastening the seat to the lavatory bowl and for assisting disabled or handicapped or crippled persons to seat on the lavatory bowl. The seat device may be easily carried with the users, and may be attached to the lavatory bowls of various toilets. The fastening device includes one or more bars for engaging onto the lavatory bowl, and for threading to the seat with a fastener. The seat includes one or more protrusions for threading with the fasteners. The bar includes one or more pegs to engage into the seat, and to anchor the bar to the seat.

10 Claims, 3 Drawing Sheets

TOILET SEAT DEVICE FOR DISABLED PERSON

BACKGROUND OF THE INVENTION

1. Field of the Invention

The present invention relates to a toilet seat device, and more particularly to an auxiliary or assisting toilet seat device having a portable structure, for detachably attaching to lavatory bowls of standard toilets, and for assisting disabled or handicapped or crippled persons to seat on the lavatory bowls of the standard toilets, and for lavatory purposes.

2. Description of the Prior Art

Typical or standard lavatory bowls of standard toilets are designed for normal or healthy persons, and comprise a conventional oval shape to support the users.

For children having smaller sizes or heights or widths, the typical or standard lavatory bowls may not be used to suitably support the children, such that auxiliary or assisting toilet seat devices are required to be provided and attached onto the typical or standard lavatory bowls of toilets, to suitably support the children.

For example, U.S. Pat. No. 5,787,518 to Mendelovich et al. discloses one of the typical auxiliary or assisting toilet seat devices and includes a seat selectively disposed on the standard lavatory bowls of toilets, and supported on the bowls with a base that is disposed on the ground.

Similarly, U.S. Pat. No. 5,809,584 to Potts discloses another typical auxiliary or assisting toilet seat device and also includes a seat selectively disposed on the standard lavatory bowls of toilets, and supported on the bowls with a carrying case that may be disposed on the ground.

However, the typical auxiliary or assisting toilet seat devices are simply disposed on and supported on the standard lavatory bowls of the toilets, but may not be solidly or stably secured or attached to the standard lavatory bowls of the toilets, such that the typical auxiliary or assisting toilet seat devices may not be used to support and to assist disabled or handicapped or crippled persons to seat on the lavatory bowls of the standard toilets, and for lavatory purposes.

The service persons have to spend a lot of force or energy to help sustain the disabled or handicapped or crippled persons to seat on the lavatory bowls of the standard toilets.

The present invention has arisen to mitigate and/or obviate the afore-described disadvantages of the conventional toilet seat devices.

SUMMARY OF THE INVENTION

The primary objective of the present invention is to provide an auxiliary or assisting toilet seat device including a structure for detachably attaching to lavatory bowls of standard toilets, and for assisting the disabled or handicapped or crippled persons to seat on the lavatory bowls of the standard toilets, and for lavatory purposes.

The other objective of the present invention is to provide an auxiliary or assisting toilet seat device including a portable structure for being easily carried with the users, and for selectively or optionally attached to the lavatory bowls of the standard toilets, to help the disabled or handicapped or crippled persons to seat on the lavatory bowls of the standard toilets.

In accordance with one aspect of the invention, there is provided a toilet seat device for attaching to lavatory bowls of toilets, the toilet seat device comprising a seat for being disposed on the lavatory bowl, and a fastener device for fastening the seat to the lavatory bowl, and for detachably attaching the seat to lavatory bowls of standard toilets, and for assisting the disabled or handicapped or crippled persons to seat on the lavatory bowls of the standard toilets, and for being easily carried with the users, and for selectively or optionally attached to the lavatory bowls of the standard toilets, to help the disabled or handicapped or crippled persons to seat on the lavatory bowls of the standard toilets.

The fastening device includes at least one bar for engaging onto the lavatory bowl, and at least one fastener engaged with the bar, to secure the bar and the seat to the lavatory bowl. The fastener includes a knob provided thereon and extended out of the bar.

The seat includes at least one protrusion having a screw hole formed therein, for threading with the fastener. The seat includes a recess formed therein, the protrusion is extended in the recess of the seat.

The seat includes at least one slot formed therein, and defined by the protrusion, and the bar includes at least one peg extended from the bar, to engage into the slot of the seat, and to anchor the bar to the seat.

The seat includes a protuberance extended therefrom, for engaging into the lavatory bowl, and for anchoring the seat to the lavatory bowl.

One or more arm rest devices may further be provided and attached to the seat, and each includes an arm attached to the seat. The seat includes at least one extension extended therefrom, the arm includes a first end pivotally secured to the extension of the seat. The extension of the seat includes a projection extended therefrom, and the first end of the arm is pivotally secured to the projection of the extension of the seat with a pivot pin.

The seat includes a second extension extended therefrom, the arm includes a second end attached to the second extension of the seat. The second extension of the seat includes a depression formed therein, and second end of the arm is received in the depression of the second extension of the seat.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
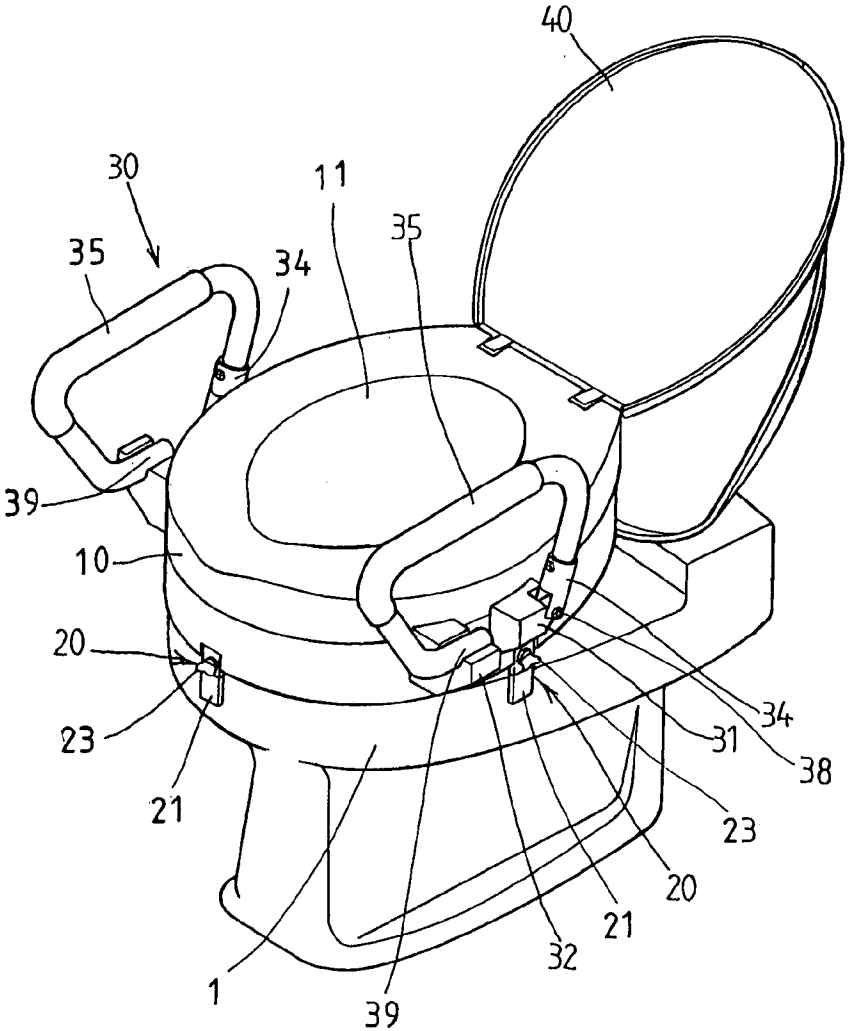
FIG. 1 is a perspective view of an auxiliary or assisting toilet seat device in accordance with the present invention which is disposed or supported on a lavatory bowl of a standard toilet.
Figure 2:
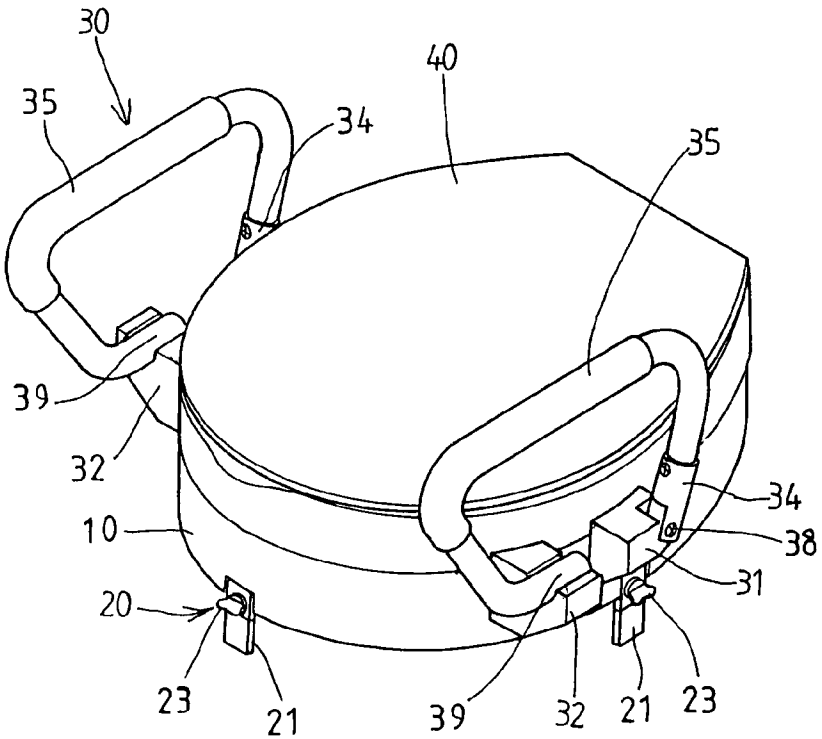
FIG. 2 is a perspective view of the auxiliary or assisting toilet seat device.
Figure 3:
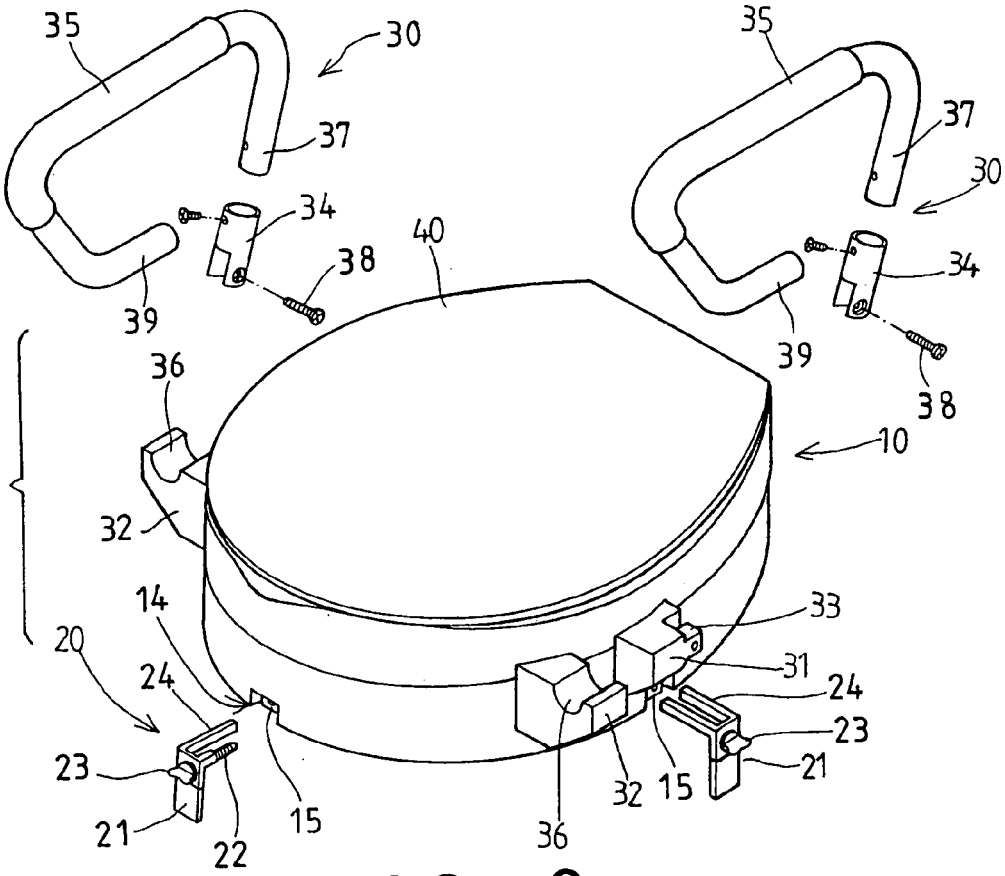
FIG. 3 is a partial exploded view of the auxiliary or assisting toilet seat device.
Figure 4:
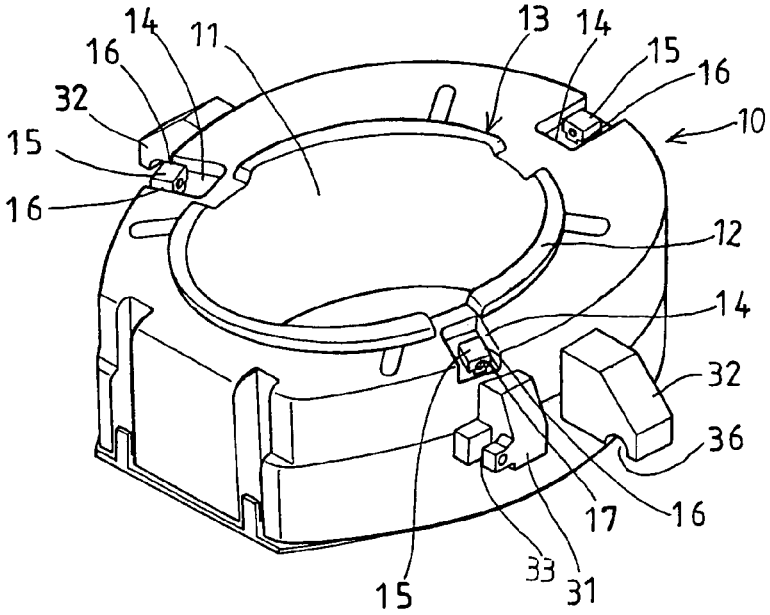
FIG. 4 is a bottom perspective view of the auxiliary or assisting toilet seat device.

Referring to the drawings, and initially to FIGS. 1–5, an auxiliary or assisting toilet seat device in accordance with the present invention comprises a seat 10 to be disposed on top of a standard lavatory bowl 1 of a toilet (FIGS. 1, 5, 6), and to be solidly or stably secured on top of the standard lavatory bowl 1, to help or to assist disabled or handicapped or crippled persons to seat on the lavatory bowls 1 of the standard toilets.

The seat 10 includes an opening 11 formed therein for aligning with the opening 19 of the lavatory bowl 1, and includes a peripheral protuberance 12 extended downwardly from the lower or bottom portion 13 thereof (FIGS. 4–6), to engage into the lavatory bowl 1, and to anchor or position the seat 10 on the lavatory bowl 1, and to prevent the seat 10 from moving laterally relative to the lavatory bowl 1.

The seat 10 further includes two or more, such as three recesses 14 formed in the lower or bottom portion 13 thereof (FIG. 4), and spaced away from each other for such as 120 degrees, and a protrusion 15 extended into each recess 14, to form or define one or more, such as two slots 16 on the sides of the protrusion 15. Each of the protrusions 15 includes a screw hole 17 formed therein, for attaching a fastener device 20 thereto.

Each of the fastener devices 20 includes a bar 21 for engaging onto the outer peripheral portion of the lavatory bowl 1, and a fastener 22 rotatably attached to the bar 21, for threading with the screw hole 17 of the protrusion 15 (FIGS. 5, 6), to attach the bar 21 onto the outer peripheral portion of the lavatory bowl 1, and to further anchor the seat 10 on the lavatory bowl 1, and to prevent the seat 10 from moving laterally relative to the lavatory bowl 1.

Each of the fasteners 22 includes a wing or a knob 23 extended or provided on the other or outer side of the bar 21, for allowing the fasteners 22 to be easily rotated relative to the bars 21 by the users. Each of the fastener devices 20 may further includes one or more, such as two pegs 24 extended from the bar 21, for engaging into the slots 16 of the seat 10, and for further anchoring or securing the bars 21 to the seat 10 and the lavatory bowl 1.

Figure 5:
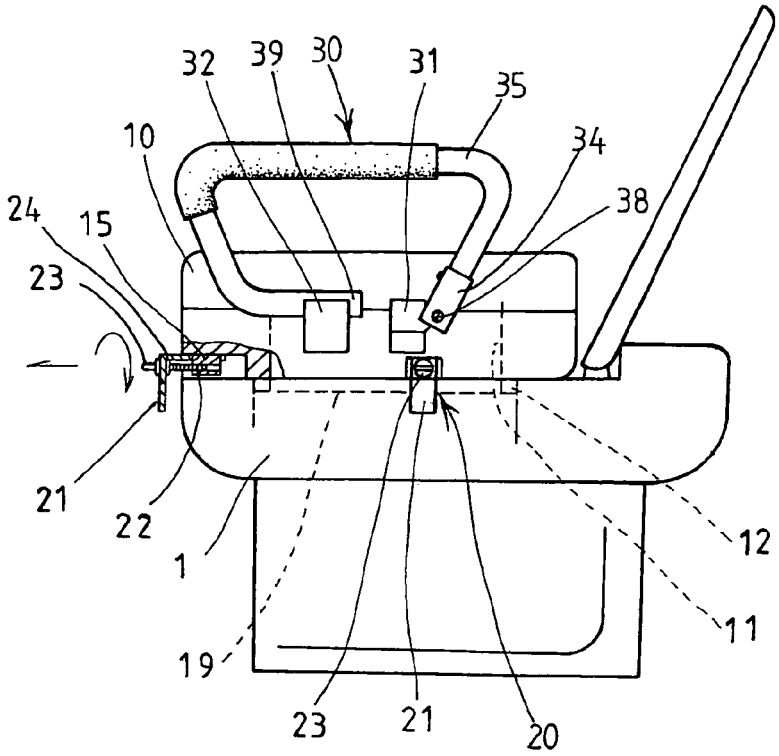
FIG. 5 is a side plan view of the auxiliary or assisting toilet seat device, in which a portion of the auxiliary or assisting toilet seat device has been cut off, to show an inner structure of the toilet seat device.
Figure 6:
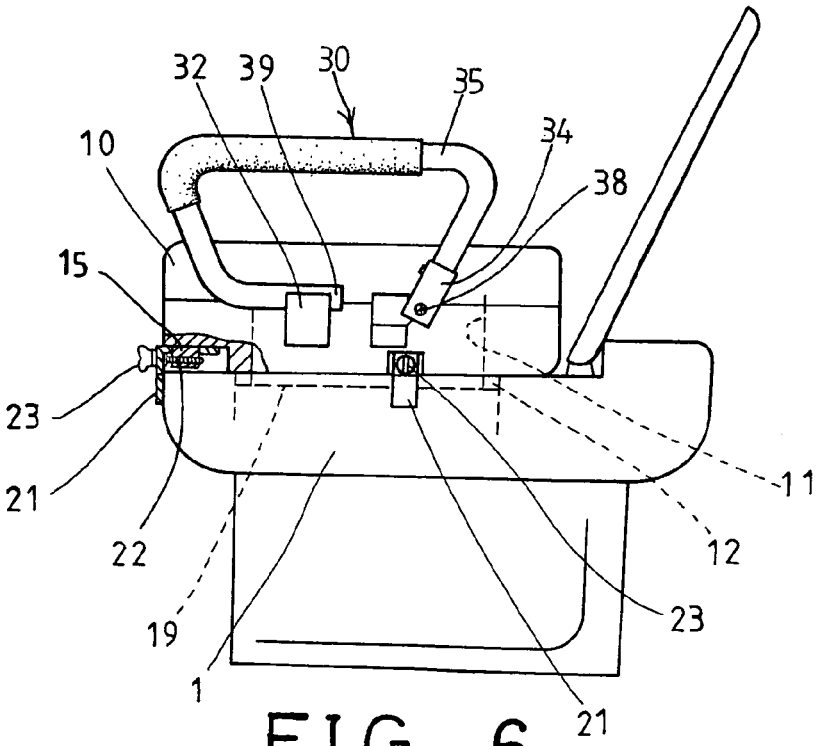
FIG. 6 is a side plan view of the auxiliary or assisting toilet seat device, similar to FIG. 5, illustrating the application or the attachment of the toilet seat device to the lavatory bowl of the standard toilet.

In operation, as shown in FIGS. 1 and 5–6, the seat 10 may be easily carried with the users, and may be disposed on or supported on the lavatory bowls 1 of the standard toilets of any other buildings or housings, to facilitate lavatory of disabled or handicapped or crippled persons. The bars 21 may be moved radially toward or away from the lavatory bowls 1, to allow the seat 10 to be easily secured or attached onto the lavatory bowls 1 of various kinds of toilets.

The seat 10 further includes one or more, such as two arm rest devices 30 for attaching to the sides of the seat 10. For example, the seat 10 includes one or more, such as two extensions 31, 32 extended or provided on each side thereof. One of the extensions 31 includes a projection 33 extended therefrom, and the other extension 32 includes a depression 36 formed therein, and preferably aligned with the projection 33 of the extension 31.

Each of the arm rest devices 30 includes an arm 35 having one end 37 pivotally or rotatably secured to the projection 33 of the extension 31 with a coupler 34 and a pivot pin 38, and the other end 39 received or rested in the depression 36 of the other extension 32, to allow the arms 35 to be supported in an erect status or position, and to be held or grasped by the users.

In operation, as shown in FIGS. 5 and 6, the seat 10 may be detachably and solidly secured onto the lavatory bowls 1 of various kinds of toilets with the fastener devices 20, to prevent the seat 10 from moving laterally relative to the lavatory bowl 1, and to help or to assist the disabled or handicapped or crippled persons for lavatory purposes.

In addition, the arm rest devices 30 may be selectively or detachably attached onto the seat 10, for being held or grasped by the users, and for allowing the disabled or handicapped or crippled persons to be easily seated and supported on the lavatory bowls 1 of the standard toilets of any other buildings or housings.

Accordingly, the auxiliary or assisting toilet seat device in accordance with the present invention includes a structure for detachably attaching to lavatory bowls of standard toilets, and for assisting the disabled or handicapped or crippled persons to seat on the lavatory bowls of the standard toilets, and for lavatory purposes, and includes a portable structure for being easily carried with the users, and for selectively or optionally attached to the lavatory bowls of the standard toilets, to help the disabled or handicapped or crippled persons to seat on the lavatory bowls of the standard toilets.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A toilet seat device for attaching to lavatory bowls of toilets, said toilet seat device comprising:

a seat for being disposed on the lavatory bowl, and said seat including a recess formed therein, and including at least one protrusion extended in said recess of said seat and having a screw hole formed therein, and means for fastening said seat to the lavatory bowl, said fastening means including at least one bar for engaging onto the lavatory bowl, and at least one fastener engaged with said at least one bar, and for threading with said screw hole of said at least one protrusion, to secure said at least one bar and said seat to the lavatory bowl.

2. The toilet seat device as claimed in claim 1, wherein said at least one fastener includes a knob provided theron and extended out of said at least one bar.

3. The toilet seat device as claimed in claim 1, wherein said seat includes at least one slot formed therein, and defined by said at least one protrusion, and said at least one bar includes at least one peg extended from said at least one bar, to engage into said at least one slot of said seat, and to anchor said at least one bar to said seat.

4. The toilet seat device as claimed in claim 1, wherein said seat includes a protuberance extended therefrom, for engaging into the lavatory bowl, and for anchoring said seat to the lavatory bowl.

5. The toilet seat device as claimed in claim 1 further comprising at least one arm rest device attached to said seat.

6. The toilet seat device as claimed in claim 5, wherein said at least one arm rest device includes an arm attached to said seat.

7. The toilet seat device as claimed in claim 6, wherein said seat includes at least one extension extended therefrom, said arm includes a first end pivotally secured to said at least one extension of said seat.

8. The toilet seat device as claimed in claim 7, wherein said at least one extension of said seat includes a projection extended therefrom, and said first end of said arm is pivotally secured to said projection of said at least one extension of said seat with a pivot pin.

9. The toilet seat device as claimed in claim 7, wherein said seat includes a second extension extended therefrom, said arm includes a second end attached to said second extension of said seat.

10. The toilet seat device as claimed in claim 7, wherein said second extension of said seat includes a depression formed therein, and second end of said arm is received in said depression of said second extension of said seat.

* * * * *